United States Patent [19]

Merz

[11] Patent Number: 5,064,132

[45] Date of Patent: Nov. 12, 1991

[54] DEVICE FOR TAKING-UP A WIDTH OF FLEXIBLE MATERIAL, PAPER IN PARTICULAR, TO FORM A ROLL

[76] Inventor: Wolf D. Merz, Nord 78, 9044 Wald Ar, Switzerland

[21] Appl. No.: 448,096

[22] Filed: Dec. 12, 1989

Related U.S. Application Data

[63] Continuation-in-part of PCT/EP89/00388, Apr. 11, 1989.

[51] Int. Cl.[5] ..... B65H 18/06; B65H 18/16; B65H 19/29

[52] U.S. Cl. ..... 242/66; 242/67.2; 242/DIG. 3; 53/463

[58] Field of Search ..... 242/66, 67.1 R, 67.2, 242/DIG. 3, 56 R, 56 A; 53/463, 118

[56] References Cited

U.S. PATENT DOCUMENTS

| | | | |
|---|---|---|---|
| 2,215,174 | 9/1940 | Dyken | 242/DIG. 3 |
| 2,706,094 | 4/1955 | Dyken | 242/DIG. 3 |
| 2,849,191 | 8/1958 | Gadler | 242/DIG. 3 |
| 3,052,073 | 9/1962 | Johansen et al. | 242/DIG. 3 |
| 3,077,316 | 2/1963 | Wells et al. | 242/DIG. 3 |
| 3,498,559 | 3/1970 | Sames | 242/67.2 |
| 3,551,260 | 12/1970 | Catherwood | 53/463 X |
| 3,720,381 | 3/1973 | Rehme et al. | 242/56 R |
| 4,784,345 | 11/1988 | Romanowski et al. | 242/DIG. 3 |
| 4,809,921 | 3/1989 | Dveck et al. | 242/66 |

FOREIGN PATENT DOCUMENTS 2248816 10/1972 Fed. Rep. of Germany .

*Primary Examiner*—John M. Jillions
*Attorney, Agent, or Firm*—Harold C. Wegner

[57] ABSTRACT

In order to automatically form rolls from web sections with computer aided drawings, a cassette (12, 16, 17) is provided in the direction of transport of the web, adjacent to a cutting arrangement (13). The cassette comprises a first cassette part (12) mounted on a frame (10) and a second cassette part (16, 17) mounted on the frame (5) in such a way that it pivots about an axis. The second cassette part (16, 17) can pivot between a first position, in which the two parts of the cassette (12, 16, 17) delimit a generally cylindrical inner space (11) for forming the roll (40), and a second position, in which the inner space (11) is opened to release the roll (40). On the frame (10) are arranged at a distance one from another a first cassette roller (18, 19) and a second cassette roller (18, 21). The axis of the first cassette roller (18, 19) corresponds to the axis of the pivoting mounting of the second cassette part (16, 17). A third cassette roller (18, 20) is moreover fixed rotatively on the second cassette part (16, 17) at a distance from the first and second cassette roller (18; 19, 21). The cassette rollers (18; 19, 20, 21) are synchronously driven and part of their external surface extends into the cylindrical inner space (11) for forming rolls. A enveloping device for winding a tape (30) around the roll (40) once it is formed as well as an arrangement for fixing the tape (30) onto itself can be added to said device.

6 Claims, 6 Drawing Sheets

Figure 1:
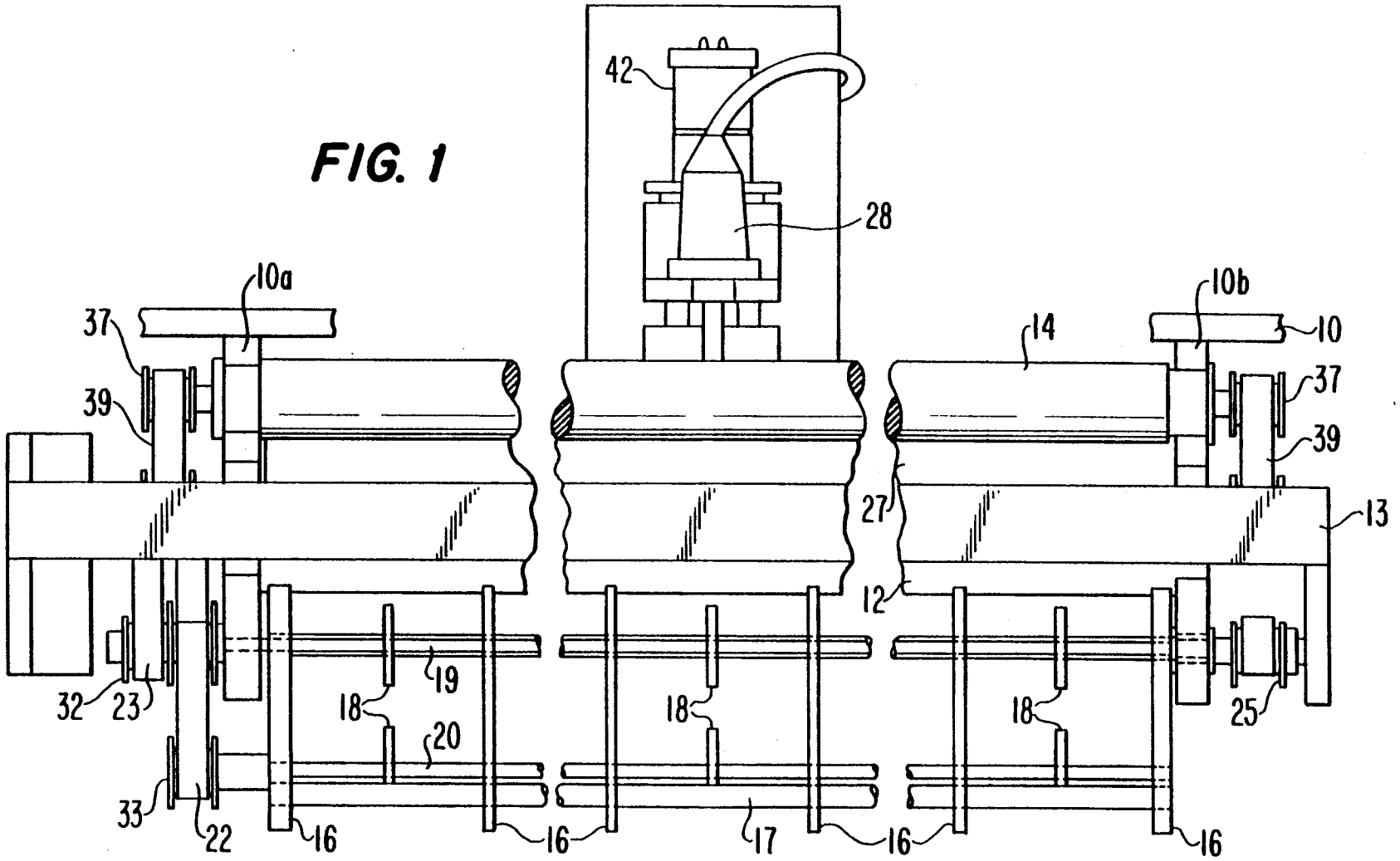

DEVICE FOR TAKING-UP A WIDTH OF FLEXIBLE MATERIAL, PAPER IN PARTICULAR, TO FORM A ROLL

This application is a continuation-in-part under 35 USC § 120 and § 365 of PCT application Ser. No. PCT/EP89/00388, filed Apr. 11, 1989.

This invention refers to a device for taking-up a width of flexible material, such as paper, to form a roll.

In such a device known from DE-A 22 48 816 a width of material is led to a cylindrical rolling area which is designed as a rolling train and consists of an upper and lower rolling train to form a roll. The rolling trains include a series of parallel rolling elements disposed at a distance from each other and driven in the same direction, which each include a shaft that holds drive disks at a distance from each other in a manner which allows the disks of a shaft between the disks to connect to the disks of the adjacent shaft(s). The upper rolling train constitutes a first frame which is equipped with two bearing blocks. During take-up of the width, the frame is mobile in an upward direction, in order to control the pressure on the layers of the roll as needed. The lower rolling train constitutes a second frame which is equipped with two bearing blocks. The second frame can be shifted with a swivel cylinder between a closed position, where the upper and lower rolling train form the cylindrical rolling area, and an open position, where the finished roll can be released from it. The shafts of the upper and lower rolling train are connected with chains in a manner which causes them to rotate in the same direction. In the closed position the rotation of the lower rolling train is conveyed to the upper rolling train by means of a bevel drive. The bevel drive is disposed in a manner that the kinematic connection of the lower rolling train with the upper rolling train is interrupted in the open position.

The large number of shafts neoessary for the rolling trains of this variant result in a very intricate construction, especially since conveying the rotation from the lower rolling train to the upper rolling train requires the bevel drive. Sinoe the lower rolling train must be tilted down when switching from the closed position into the open position, the weight of the lower rolling train and the roll in the rolling area must be supported by a swivel cylinder, which must be strong enough for this task.

The purpose of this invention is the creation of a device which fulfills the function in a manner which requires a less complex structure. This goal is achieved by the present invention The device of this invention allows the formation of a roll of a width of flexible material, which has been cut with a cutting mechanism, and the delivery of this roll to storage without requiring an operator. If then a series of cutting patterns, divided into individual jobs, are drawn on the width of paper by a drawing device controlled by a computer, the individual jobs are cut by a computer controlled device and given roll form, whereby these rolls are collected in a storage facility. In order for the roll to retain its shape after delivery to the storage facility, the flexible material either maintains its form when rolled, is self-adhesive yet separable, or is provided with an adhesive agent.

Construction of the device according to this invention requires only a small construction effort. Since the swivel axis of the second frame is the same as the axis of the first roller, the distance of the first roller to the second, and the distance of the second roller to the third roller when tilted, respectively, is constant. This allows a simple kinematic connection between the first roller and the second, and the third, respectively. This connection, for example, can be established by connecting the cog wheels disposed at the front end of the rollers with an engaging gear belt. The arrangement of the rollers allows the use of one-piece rollers, since the rolling area for the formation of the roll is comprised of the two frames and because the rollers sole function is the transport of the width of material in the formation of the roll. The second frame is held in a closed position by its own weight and can easily be moved into its open position. This allows the use of a low performance swivel drive.

The arrangement of the rollers in aooordance with a preferred embodiment of the invention makes it possible to convey sufficient frictional force onto the width of material so the roll can be formed. This allows the reduction of the weight of the rollers and makes considerable savings of material possible.

The design of the device according to the specifications of a further preferred embodiment assures that only one drive is necessary.

If the flexible material does not maintain its shape when rolled or if no adhesive agent is used to fasten the roll, an enveloping mechanism according to a further preferred embodiment is used. The enveloping tape may be adhesive to itself.

Alternatively, a fastening device according to a further preferred embodiment may be employed, which fastens the tape to itself and which is attached to the frame. In this fashion, the rolls thus formed may be cut from the width and enveloped in a controlled manner according to a certain point in time.

This invention is explained below in more detail with explanations of the preferred embodiments of the invention and reference to the drawings. The following items are shown:

FIG. 1—A top view of the device.

Figure 2:
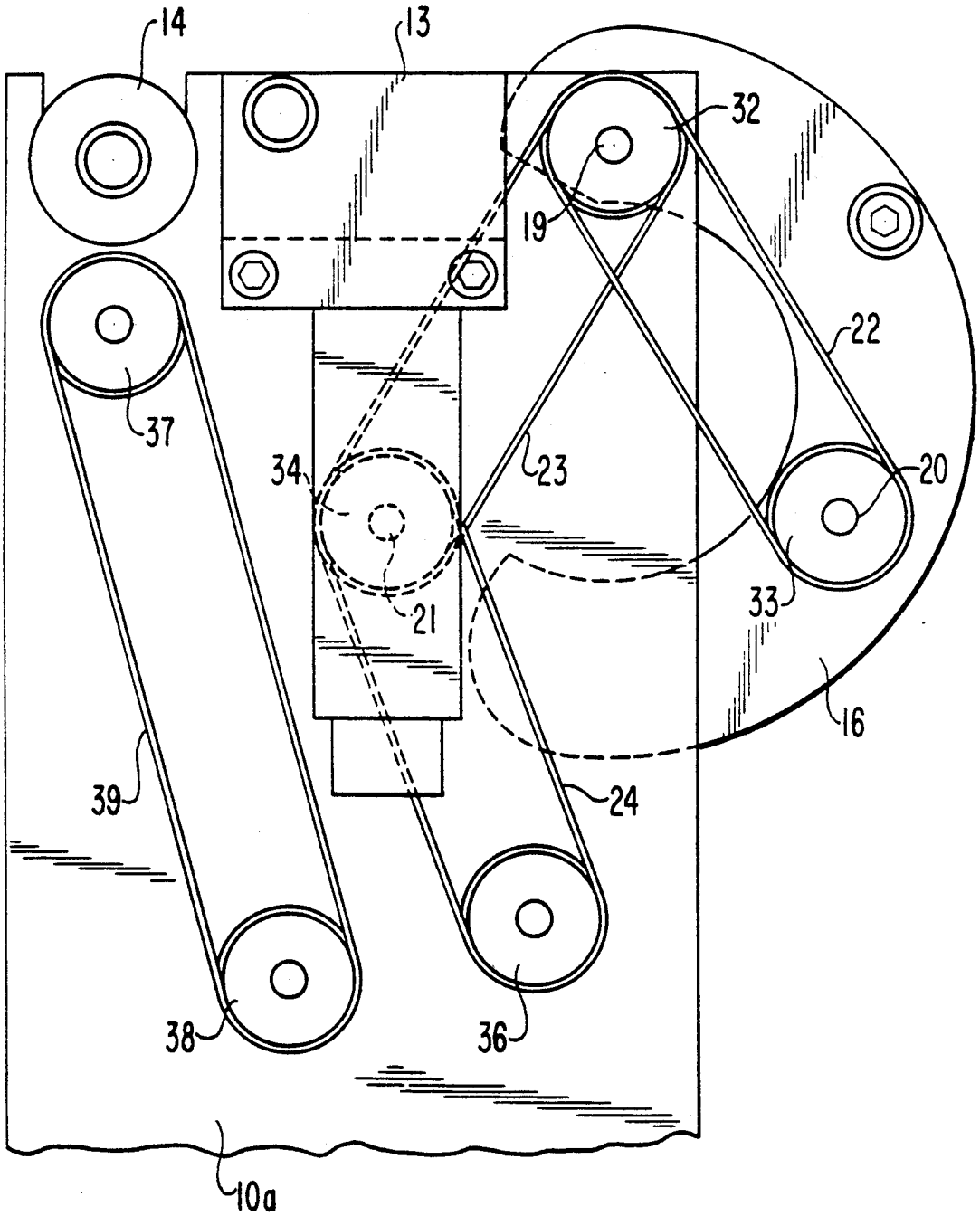

FIG. 2—A frontal view of the device.

Figure 3:
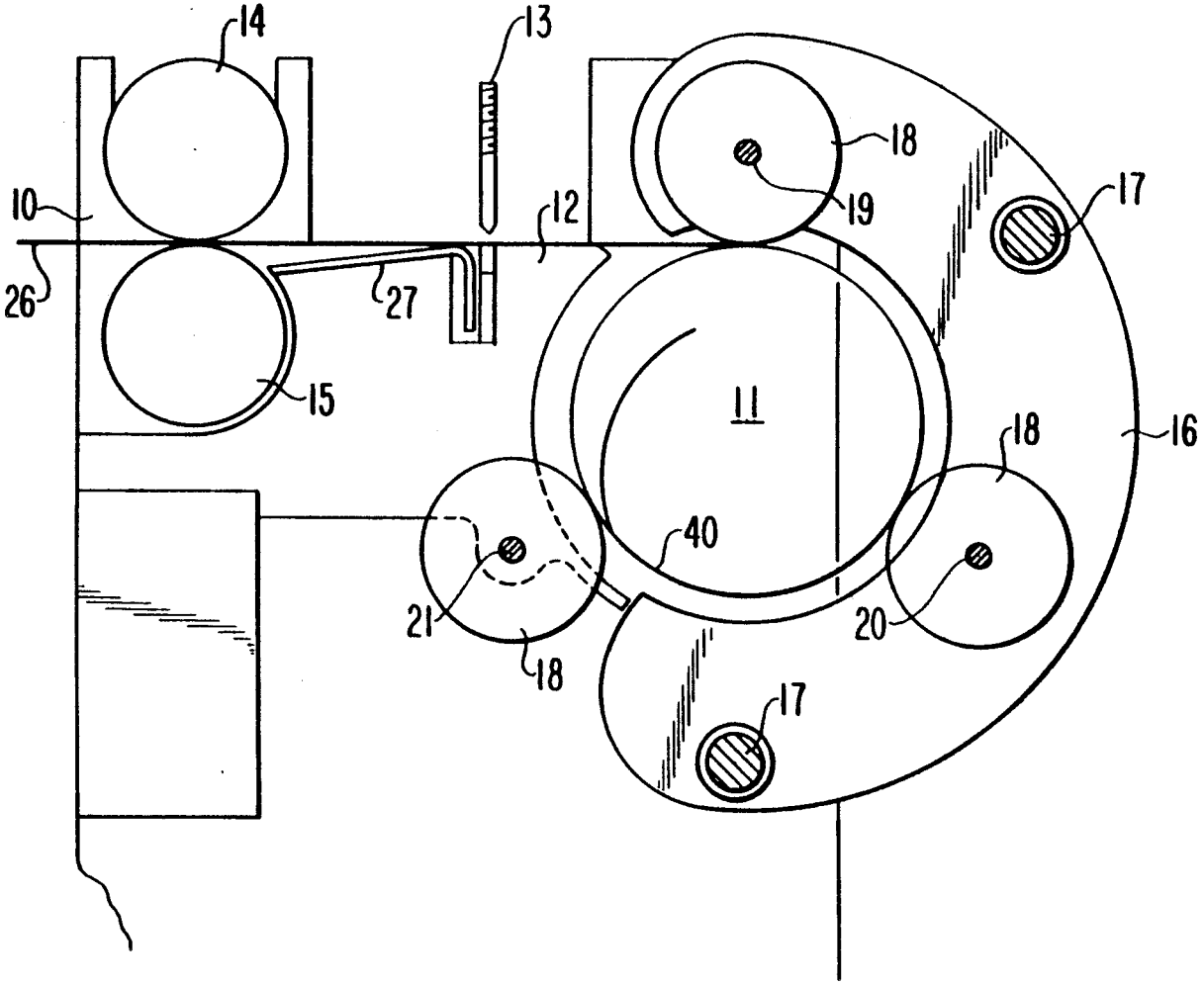

FIG. 3—A cross-section of the device during the formation of a roll

Figure 4:
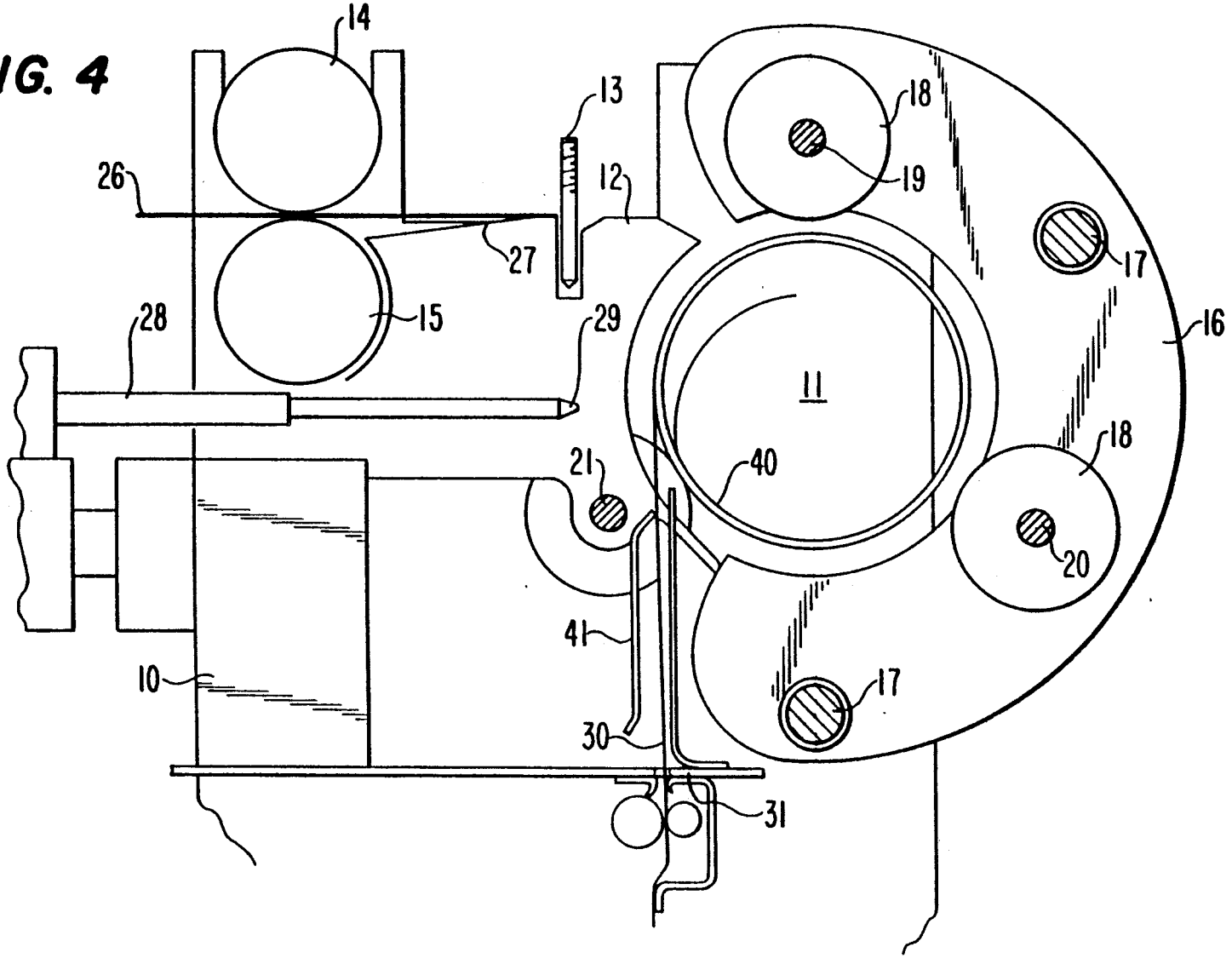

FIG. 4—A cross-section of the device whereby a tape is fed to envelope the roll that has been formed.

Figure 5:
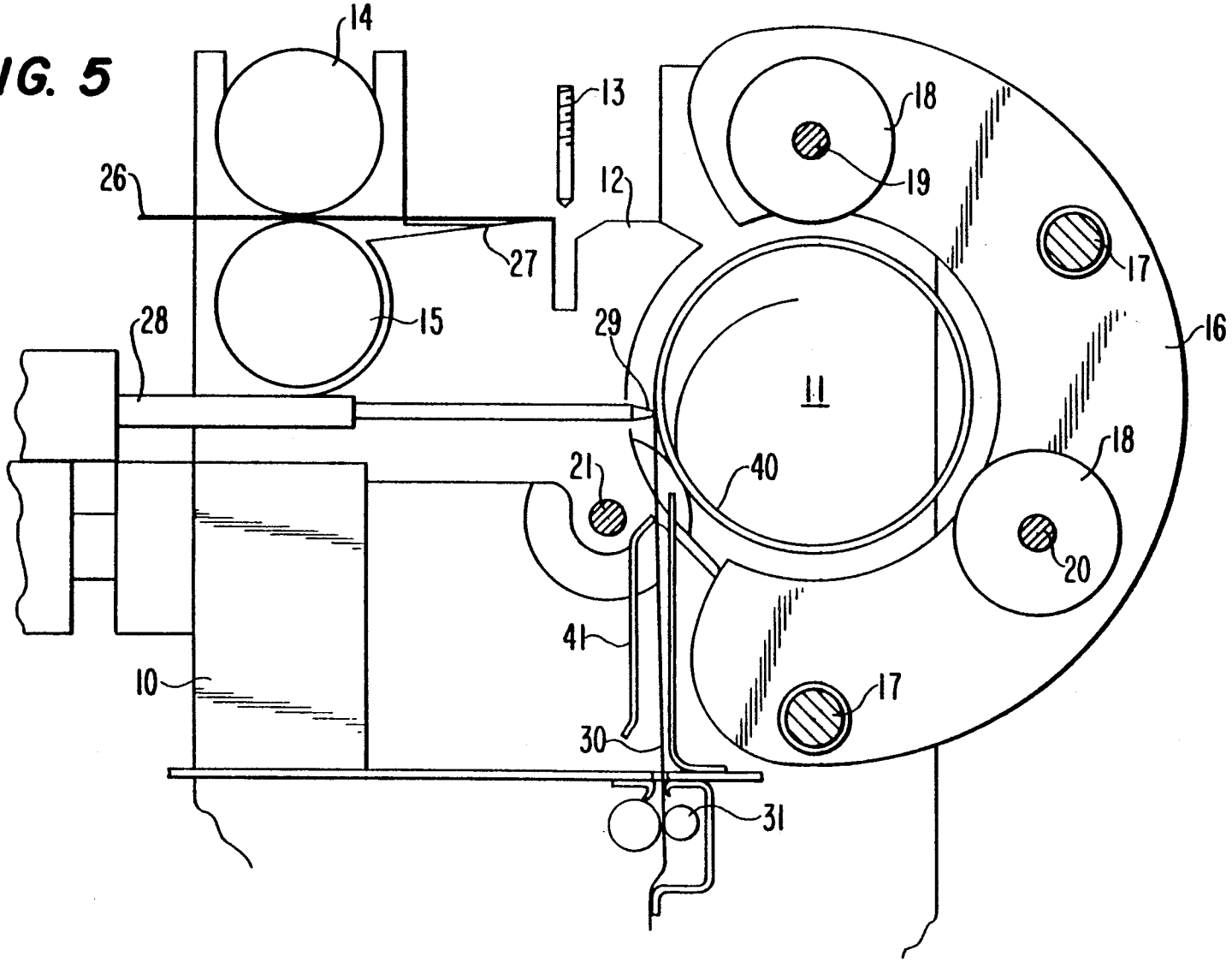

FIG. 5—A cross-section of the device whereby the tape is fused thermally.

Figure 6:
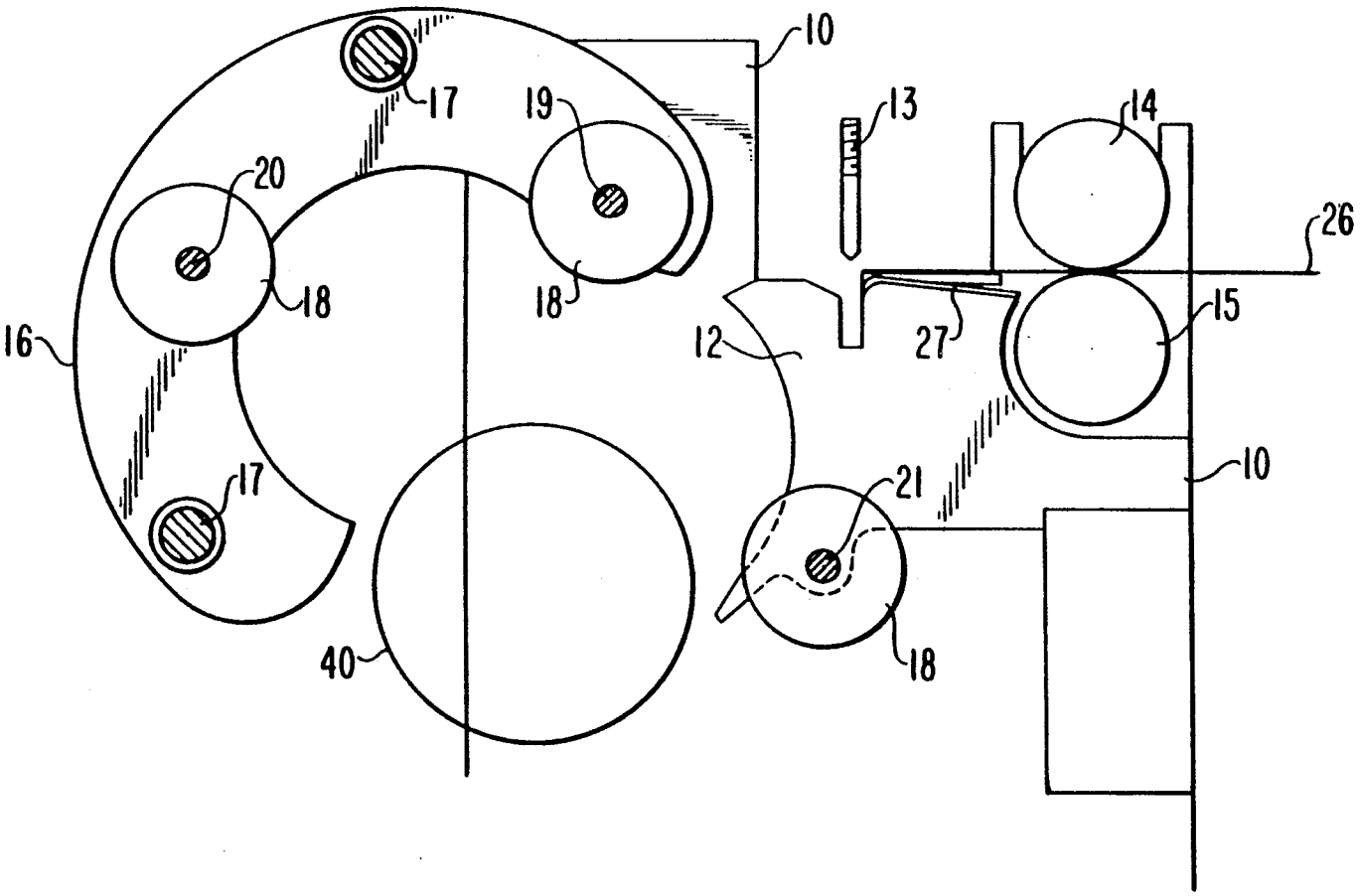

FIG. 6—A cross-section of the device in a position where the rolling area is open to release the roll.

As is shown in FIG. 1 to FIG. 6, the device is disposed following a cutting device (13), here indicated only by a representation of the knife. The width of material (26) is fed to the cutting device (13) by means of a transport mechanism, which here is represented only by one pressing roller (14), a transport roller (15), and a guiding plate (27).

The device includes one frame (12) which is fixed to the structure (10) and one bows which is formed by arched other through rods (17). The frame formed by arched bows (16) is held in a manner which allows it to rotate about axis 19, which is above the width of material (26) that has been fed. In the preferred embodiment shown, each bow 16 is a disk-like ring segment with an extension of approx. 200°. The first and second frames establish a cassette and in closed position enclose a cylindrical rolling area (11) into which the width of material (26) is fed essentially in a tangential direction.

Furthermore the device has two lateral bearing blocks (10*a*, 10*b*) on the sides of the structure (10) which hold the rollers and one roller which is held in place at the front end of the arched bows (16) of the second frame. Each roller constitutes a rolling element and includes a shaft (19, 20, 21) which hold drive disks that are disposed at a distance from each other and are firmly fastened to the shaft. The drive disks (18) are arranged between the bows (16) and part of their circumference extends into the cylindrical rolling area (11). In the preferred embodiment, the axes of shafts 19, 20, and 21 are disposed at the corners of an equilateral triangle. The axis of shaft 19 coincides with the swivel axis of the second frame and the lateral bearing blocks 10*a*, 10*b* of the structure (10) above the width of material (26). Shafts 19 and 20 extend through the appropriate openings in bows 16 of the tiltable second frame; shaft 21 extends through the appropriate openings in the first frame which is firmly attached to the frame structure.

As can be seen from FIG. 1 and FIG. 2, shafts 19, 20, 21 are held in place by one bearing block (10*a*) of the structure (10) and on the ends protruding from the bearing blocks they carry a cog wheel (32, 33, 34). A gear belt (22) connects cog wheel 32 on shaft 19 with cog wheel 33 on shaft 20. Cog wheel 32 on shaft 19 is also connected to cog wheel 34 on shaft 21 with yet another gear belt. Another gear belt connects cog wheel 34 on shaft 21 with the driving cog wheel (36), which is held by bearing block 10*a* and whose driving force is not depicted here. As can be seen in FIG. 2, cog wheel 37 is disposed on the end of the transport roller (15) which at one end is held by bearing block 10*a* of the structure (10). This cog wheel is driven by a gear belt connecting it with cog wheel S8 which is held by bearing block 10*a*. The driving force of cog wheel 38 is not depicted here.

On the opposite front of the rolling area (11). shaft 19 is held in place in a sleeve jacket which extends beyond bearing block 10*b* which is fastened to bow 16 and is secured in bearing block 10*b* of the structure (10) in a manner which allows rotation. On the other end of this sleeve jacket is a cog wheel (25). In this preferred embodiment, its axis runs coaxial to the axis of shaft 19 and it is driven by a cog wheel (not depicted here) via a gear belt which serves to shift the second frame formed by bows 16 and rods 17 between the closed position shown in FIGS. 3, 4, and 5 for the formation of a cylindrical, cassette-like rolling area (11) and the open position shown in FIG. 6, where the second frame is tilted about 60° upward from the closed position.

As is shown in FIGS. 4 and 5 an enveloping device is provided below the rolling area (11). To envelope the roll (40) it feeds a tape (30) from a roll, which is mounted on the structure (10) (not depicted here), tangentially to the guiding plate (41) and into the cylindrical rolling area (11) via a tape transport mechanism (31).

Fusing of the tape onto itself is achieved by means of a fusing device (28) which is mounted on the structure (10). The fusing device (28) consists of a heatable pin (29) which is switched by a drive (42) from a neutral position outside the rolling area (11) (FIG. 4) to a fixed position in the cylindrical rolling area (11) (FIG. 5).

A programmable control device in connection with a computer guided drawing instrument controls the drive of the transport roller (15), the rollers 19, 20, and 21, the reversible drive of cog wheel 25, the tape transport mechanism (31), the cutting device (13), and the drive (42) of the fusing device (28) according to a predetermined pattern.

The width of material (26), which has been covered with a set of cutting patterns by the drawing device, runs between transport roller 15 and pressure roller 14, over guiding plate 27 into the cylindrical rolling area (11). The drive disks catch the width and lead it along the cylindrical surfaces of the rolling area, forming roll 40. To prevent jamming of the cylindrical rolling area the driving disks (18) rotate somewhat faster than the transport roller (15).

If the width (26) has been pulled over the distance designed for drawing, the drives for transport roller 15 and drive disks (18) are stopped, whereby the drive of drive disks (18) has a slight lag. The lag of the drive disks causes a tightening of the paper, which has a favorable effect when cutting the sheet. Then the cutting device (13) is actuated, cutting the width at the determined place (FIG. 4). When the width is cut, the drives of drive disks 18 and of transport mechanism 31 are switched on simultaneously. In this manner the section of the sheet cut from the width (26) still outside the cylindrical rolling area (11) is drawn into it and at the same time tape 30 is fed tangentially to guiding plate 41 and to the newly formed roll (40) in the cylindrical rolling area. The drive of drive disks (18) and of transport mechanism 31 remains in operation until the tape (30) is wrapped around the roll a bit more than one full circle. Then the drives of drive disks 18 and tape transport mechanism 31 are stopped. At the same time the heatable pin (29) is brought close to the tape (30) by drive 42, causing it to fuse to itself and to be cut (FIG. 5). Then the heatable pin is brought back into its neutral position. Subsequently the drive of cog wheel 25 is activated, causing the second frame, i.e. the bows which are connected by rods to tilt upward about the axis of shaft 19, so the roll (40) secured with tape can drop into a storage facility (FIG. 6). Finally the second frame is tilted back in the closed position by the drive of cog wheel 20 and the cylindrical rolling area is again ready to form the next roll (40).

What is claimed is:

1. A device for taking up a width of a flexible material in a roll, whereby the rolling area is provided with an entry slot formed by first and second frames whose position can be changed between an open position, for dispensing, and a closed position, for take-up, said second frame being rotatable about an axis, and wherein each of the frames are held by two bearing blocks spaced on opposite sides by a predetermined distance from each other, between which powered rolling elements are disposed at and resting against the circumference of the roll that is being formed, wherein:

the first frame is fixed, said first frame having rolling elements including a first roller, and a second roller disposed a circumferential distance from said first roller;

the axis of said first roller being coincident with the axis about which said second frame rotates, said axis being located above the take-up slot;

said second frame having a rolling element including a third roller which is disposed a circumferential distance from said first and second rollers;

said first and second frames form an inner hull which provides a boundary for the rolling area, whereby said first, second and third rollers extend into the rolling area; and wherein each of said rollers include a shaft which holds drive disks spaced axially from each other and fixed to the shaft, and wherein said second frame is provided with arched bows connected by rods, whereby the drive disks of said first and third roller are disposed between said arched bows.

2. A device for taking up a width of a flexible material in a roll, whereby the rolling area is provided with an entry slot formed by first and second frames whose position can be changed between an open position, for dispensing, and a closed position, for take-up, said second frame being rotatable about an axis, and wherein each of the frames are held by two bearing blocks spaced on opposite sides by a predetermined distance from each other, between which powered rolling elements are disposed at and resting against the circumference of the roll that is being formed, wherein:

the first frame is fixed, said first frame having rolling elements including a first roller, and a second roller disposed a circumferential distance from said first roller;

the axis of said first roller being coincident with the axis about which said secodn frame rotates, said axis being located above the take-up slot;

said second frame having a rolling element including a third roller which is disposed a circumferential distance from said first and second rollers;

said first and second frames form an inner hull which provides a boundary for the rolling area, whereby said first, second and third rollers extend into the rolling area; and wherein a cog wheel is disposed on said swivel axis of said second frame on the exterior side of its bearing blocks, said cog wheel being driven by a gear belt in the reverse direction to swivel the second frame.

3. A device for taking up a width of a flexible material in a roll, whereby the rolling area is provided with an entry slot formed by first and second frames whose position can be changed between an open position, for dispensing, and a closed position, for take-up, said second frame being rotatable about an axis, and wherein each of the frames are held by two bearing blocks spaced on opposite sides by a predetermined distance from each other, between which powered rolling elements are disposed at and resting against the circumference of the roll that is being formed, wherein:

the first frame is fixed, said first frame having rolling elements including a first roller, and a second roller disposed a circumferential distance from said first roller;

the axis of said first roller being coincident with the axis about which said second frame rotates, said axis being located above the take-up slot;

said second frame having a rolling element including a third roller which is disposed a circumferential distance from said first and second rollers; and said first and second frames form an inner hull which provides a boundary for the rolling area, whereby said first, second and third rollers extend into the rolling area, said device further comprising a mechanism for winding a tape around a roll, said winding mechanism being rotatably disposed on the structure and said mechanism including a tape and a tape transport mechanism which guides the tape tangentialoly into the rolling area, and means for fastening the tape, said means being mounted on a structure, thus allowing the tape to be fastened to itself, whereby the fastening means can be shifted between a neutral position outside the two frames and a fastening position inside the rolling area, where it engages the tape.

4. A device as in claim 3 wherein, in the closed position of the frames, the axes of the rollers are disposed in the corners of an equilateral triangle.

5. A device as in claim 3 wherien, at the exterior of each of said bearing blocks of said first and second frames a cog wheel is disposed on axles of each of said rollers so that the cog wheel on the axle of the first roller is connected to the cog wheel on the axle of the third roller, and to the cog wheel of the second roller, respectively, by a gear belt.

6. A device as in claim 3, wherein said fastening means includes a heatable pin for thermal fusing and cutting of the tape.

* * * * *